US006942091B1

(12) United States Patent
Alderson

(10) Patent No.: US 6,942,091 B1
(45) Date of Patent: Sep. 13, 2005

(54) BOX FOR STORING MATCHES

(76) Inventor: Martha J. Alderson, P.O. Box 161, Point Blank, TX (US) 77364

( * ) Notice: Subject to any disclaimer, the term of this patent is extended or adjusted under 35 U.S.C. 154(b) by 129 days.

(21) Appl. No.: 10/119,740

(22) Filed: Apr. 9, 2002

(51) Int. Cl.[7] ..... A24F 27/00
(52) U.S. Cl. ..... 206/137; 206/96; 206/131
(58) Field of Search ..... 206/90, 121, 127, 206/137, 96, 131, 98

(56) References Cited

U.S. PATENT DOCUMENTS

| | | | | | |
|---|---|---|---|---|---|
| 439,467 | A | * | 11/1890 | Brandt | 254/385 |
| 589,206 | A | * | 8/1897 | Fortescue | 206/121 |
| D30,981 | S | * | 6/1899 | Doescher | D27/173 |
| 714,749 | A | * | 12/1902 | Seiler | 206/121 |
| 729,818 | A | * | 6/1903 | Wattenberg | 206/137 |
| 759,578 | A | * | 5/1904 | Williams | 220/62 |
| 761,461 | A | * | 5/1904 | Vom Eigen | 206/137 |
| 829,598 | A | * | 8/1906 | Ohl | 206/121 |
| 1,174,474 | A | * | 3/1916 | Brown | 206/135 |
| 1,203,787 | A | * | 11/1916 | Rietveld | 206/121 |
| 1,283,376 | A | * | 10/1918 | Vom Eigen | 206/137 |
| 1,371,982 | A | * | 3/1921 | Sartin | 312/73 |
| 1,381,522 | A | * | 6/1921 | Van Senus | 206/131 |
| 1,450,963 | A | * | 4/1923 | Szastalo | 206/137 |
| 1,582,025 | A | * | 4/1926 | Caldwell | 206/91 |
| 4,076,117 | A | * | 2/1978 | Wisdom et al. | 206/106 |
| 4,497,401 | A | * | 2/1985 | Ackerman | 206/131 |
| 5,358,140 | A | * | 10/1994 | Pellegrino | 221/25 |

* cited by examiner

*Primary Examiner*—Jila M. Mohandesi

(57) ABSTRACT

Boxes for storing matches house matches. By keeping them in a weather resistant environment, the matches are prevented from degrading. Use of a lid, flap, and a latching mechanism improve safety by ensuring that the matches remain within the match holder. A replaceable strike strip allows the box for matches to be used for many years. Also, the provided adhesive strip lets the user place the box for matches anyplace where ready access to matches is desirable.

1 Claim, 3 Drawing Sheets

BOX FOR STORING MATCHES

BACKGROUND OF THE INVENTION

1. Field of the Invention

The present invention relates to a box for storing matches for use in connection with matches. The box for storing matches has particular utility in connection with protecting matches and making them readily available.

2. Description of the Prior Art

Boxes for storing matches are desirable for housing matches. By keeping them in a weather resistant environment, the matches are prevented from degrading. Use of a lid, flap, and a latching mechanism improve safety by ensuring that the matches remain within the match holder. A replaceable strike strip allows the box for matches to be used for many years. Also, the provided adhesive strip lets the user place the box for matches anyplace where ready access to matches is desirable.

The use of decorative dispensing containers is known in the prior art. For example, U.S. Pat. No. 4,497,401 to Ackerman discloses decorative dispensing containers. However, the Ackerman '401 patent does not have a replaceable strike strip, and has further drawbacks of requiring removal of both a case and a sleeve before objects enclosed within can be accessed.

U.S. Pat. No. 3,550,762 to Gau discloses a box, specifically for matches. However, the Gau '762 patent does not have a strike strip, and additionally does not have a hingedly attached lid.

Similarly, U.S. Pat. No. Des. 30,981 to Doescher discloses a design for a match-box. However, the Doescher '981 patent does not have a strike strip, and also does not have a lid latching mechanism.

In addition, U.S. Pat. No. 4,917,236 to Galvez-Moran discloses a decorative match book type assembly and photographic display. However, the Galvez-Moran '236 patent does not fully enclose the matches contained within, and has the additional deficiency of lacking a replaceable strike strip.

Furthermore, U.S. Pat. No. 4,705,164 to Parein discloses a package for matches. However, the Parein '164 patent's self-lighting nature renders it more vulnerable to being misused by children, and it cannot be refilled with matches.

Lastly, U.S. Pat. No. 4,176,742 to Muhlethaler discloses a match carrier including frangible protrusions that kindles a match upon withdrawal. However, the Muhlethaler '742 patent's self-lighting nature renders it more vulnerable to being misused by children, and it also has the additional deficiency of not being refillable with matches.

While the above-described devices fulfill their respective, particular objectives and requirements, the aforementioned patents do not describe a box for storing matches that allows protecting matches and making them readily available. The Ackerman '401 patent and the Galvez-Moran '236 patent do not have replaceable strike strips. The Gau '762 patent and the Doescher '981 patent make no provision for a strike strip. The Parein '164 patent and the Muhlethaler '742 patent cannot be refilled with matches.

Therefore, a need exists for a new and improved box for storing matches that can be used for protecting matches and making them readily available. In this regard, the present invention substantially fulfills this need. In this respect, the box for storing matches according to the present invention substantially departs from the conventional concepts and designs of the prior art, and in doing so provides an apparatus primarily developed for the purpose of protecting matches and making them readily available.

SUMMARY OF THE INVENTION

In view of the foregoing disadvantages inherent in the known types of decorative dispensing containers now present in the prior art, the present invention provides an improved box for storing matches, and overcomes the above-mentioned disadvantages and drawbacks of the prior art. As such, the general purpose of the present invention, which will be described subsequently in greater detail, is to provide a new and improved box for storing matches and method which has all the advantages of the prior art mentioned heretofore and many novel features that result in a box for storing matches which is not anticipated, rendered obvious, suggested, or even implied by the prior art, either alone or in any combination thereof.

To attain this, the present invention essentially comprises a match holder with a lid hingedly attached to the upper edge of the rear wall of the match holder.

There has thus been outlined, rather broadly, the more important features of the invention in order that the detailed description thereof that follows may be better understood and in order that the present contribution to the art may be better appreciated.

The invention may also include a flap attached to the front edge of the lid. A latching mechanism may be employed to removably secure the flap to the front wall of the match holder. The latching mechanism may take the form of a snap fastener or a hook and loop fastener. A replaceable strike strip may be present on the rear wall of the match holder. The strike strip may be secured by an adhesive or a plurality of screws and strike strip mounting brackets. An adhesive strip with an adhesive protection strip may be attached to the bottom wall of the match holder. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved box for storing matches that has all of the advantages of the prior art decorative dispensing containers and none of the disadvantages.

It is another object of the present invention to provide a new and improved box for storing matches that may be easily and efficiently manufactured and marketed.

An even further object of the present invention is to provide a new and improved box for storing matches that has a low cost of manufacture with regard to both materials and labor, and which accordingly is then susceptible of low prices of sale to the consuming public, thereby making such box for storing matches economically available to the buying public.

Still another object of the present invention is to provide a new box for storing matches that provides in the apparatuses and methods of the prior art some of the advantages thereof, while simultaneously overcoming some of the disadvantages normally associated therewith.

Even still another object of the present invention is to provide a box for storing matches for protecting matches and making them readily available. This allows matches to always be readily accessible since the box for storing matches can be mounted on a variety of surfaces.

Still yet another object of the present invention is to provide a box for storing matches for protecting matches and making them readily available. This makes it possible to prevent the matches from degrading from exposure to environmental conditions.

A further object of the present invention is to provide a box for storing matches for protecting matches and making them readily available. This ensures that the matches remain within the match holder.

An additional object of the present invention is to provide a box for storing matches for protecting matches and making them readily available. This allows replacement of the strike strip when it is worn out.

A still further object of the present invention is to provide a box for storing matches for protecting matches and making them readily available. This makes it possible to refill the box for storing matches once its supply of matches has been exhausted.

Lastly, it is an object of the present invention to provide a new and improved box for storing matches for protecting matches and making them readily available.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
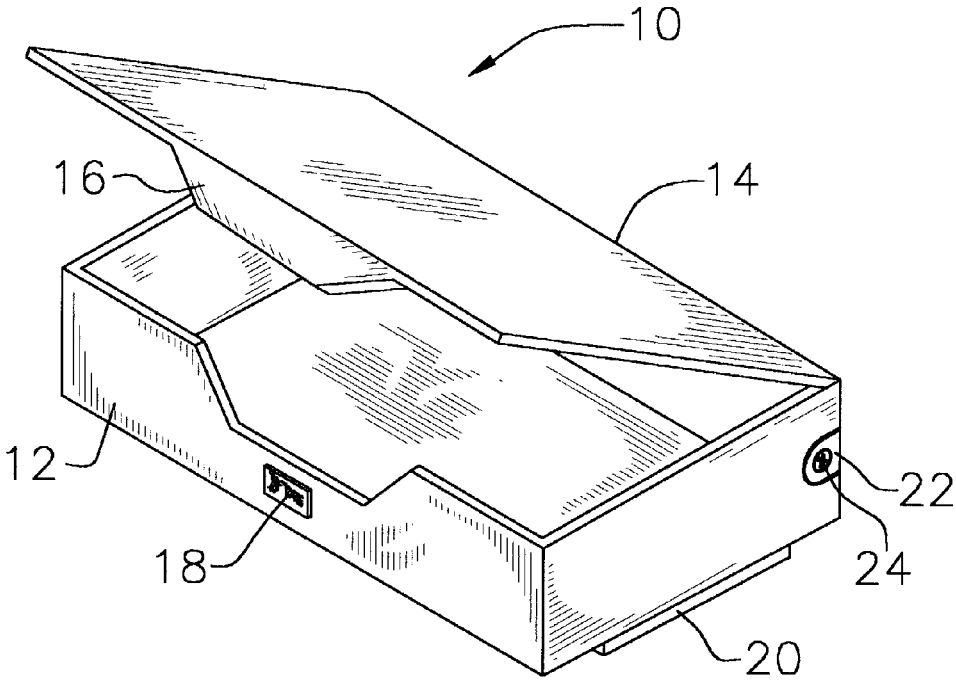
FIG. 1 is a top perspective view of the current embodiment of the box for storing matches constructed in accordance with the principles of the present invention.

Referring now to the drawings, and particularly to FIGS. 1–5, a current embodiment of the box for storing matches of the present invention is shown and generally designated by the reference numeral 10.

In FIG. 1, a new and improved box for storing matches 10 of the present invention for protecting matches and making them readily available is illustrated and will be described. More particularly, the box for storing matches 10 has a match holder 12 made of plastic. The match holder 12 is rectangular and measures approximately four inches long by three inches deep. Hingedly attached to match holder 12 is a lid 14 made of plastic. Attached to the front of lid 14 is flap 16, which is approximately two inches wide and also made of plastic. Attached to the front wall of match holder 12 is the loop portion of hook and loop fastener 18. The hook portion of hook and loop fastener 18 is attached to the underside of flap 16 (not shown). Adhesive strip 20 is shown attached to the underside of match holder 12. Strike strip mounting bracket 22 is shown threadedly attached by screw 24 to the side wall of match holder 12.

Figure 2:
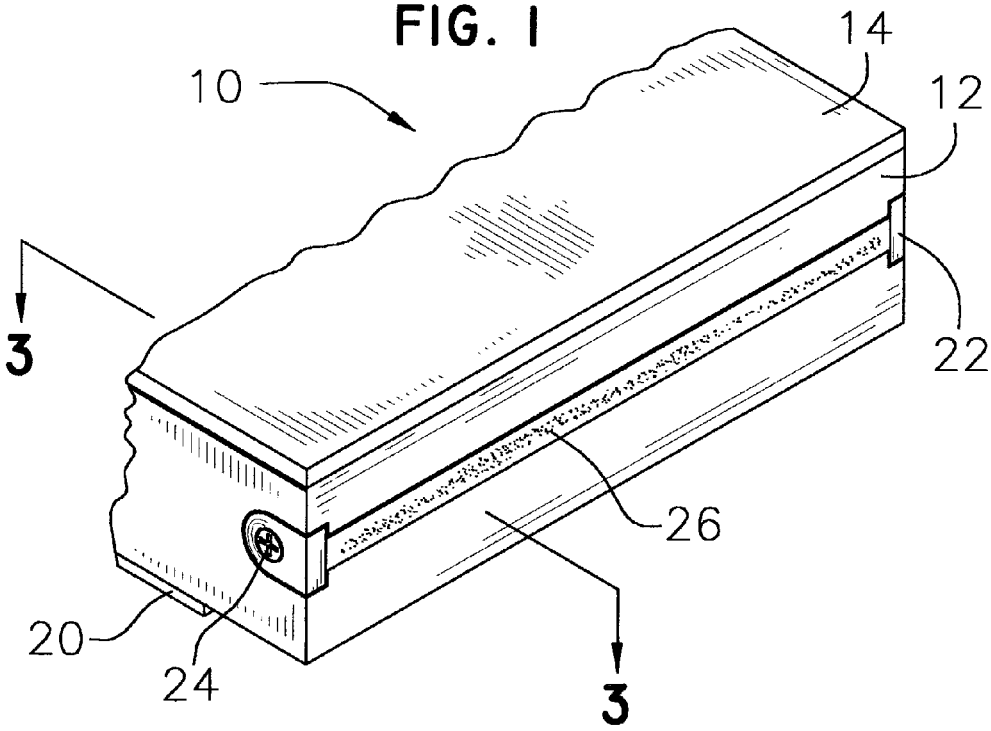
FIG. 2 is a left perspective view of the box for storing matches of the present invention.

Moving on to FIG. 2, a new and improved box for storing matches 10 of the present invention for protecting matches and making them readily available is illustrated and will be described. More particularly, the box for storing matches 10 has a match holder 12. Mounted on the rear wall of match holder 12 by strike strip mounting bracket 22 and screw 24 is strike strip 26. Lid 14 is shown hingedly attached to the rear wall of match holder 12. Adhesive strip 20 is shown attached to the underside of match holder 12.

Figure 3:
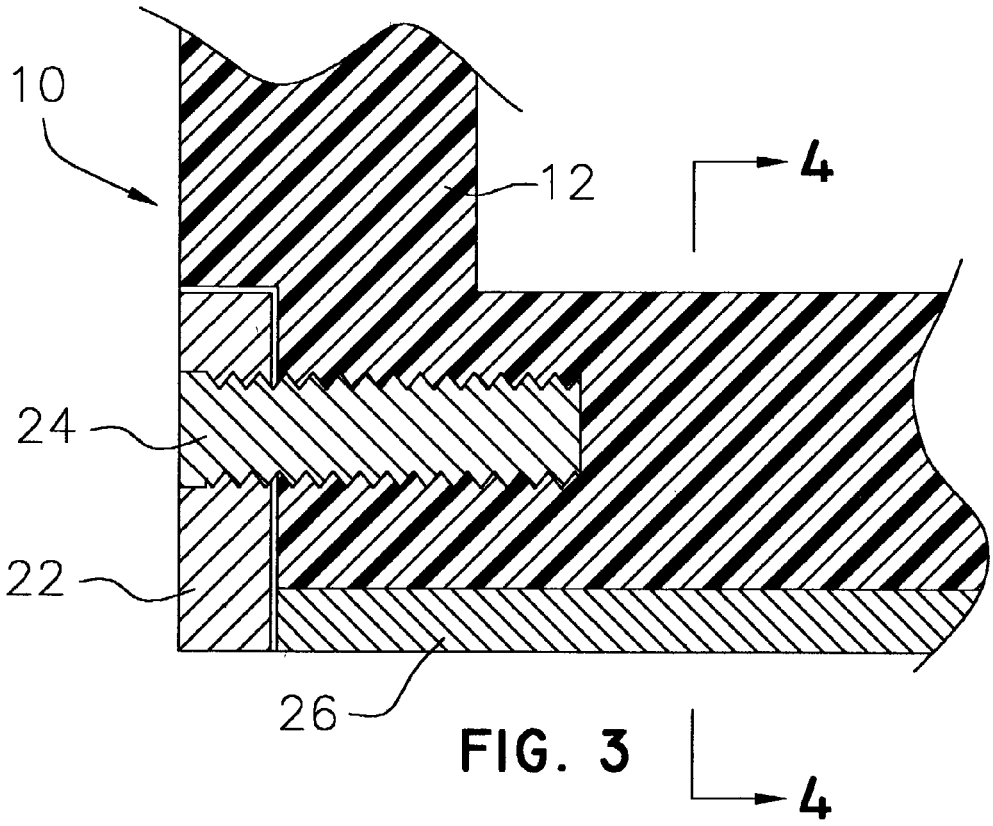
FIG. 3 is a top sectional view of the box for storing matches of the present invention.

Continuing with FIG. 3, a new and improved box for storing matches 10 of the present invention for protecting matches and making them readily available is illustrated and will be described. More particularly, the box for storing matches 10 has a match holder 12. Screw 24 is shown threadedly attaching strike strip mounting bracket 22 to the side wall of match holder 12 in order to hold strike strip 26 in place.

Figure 4:
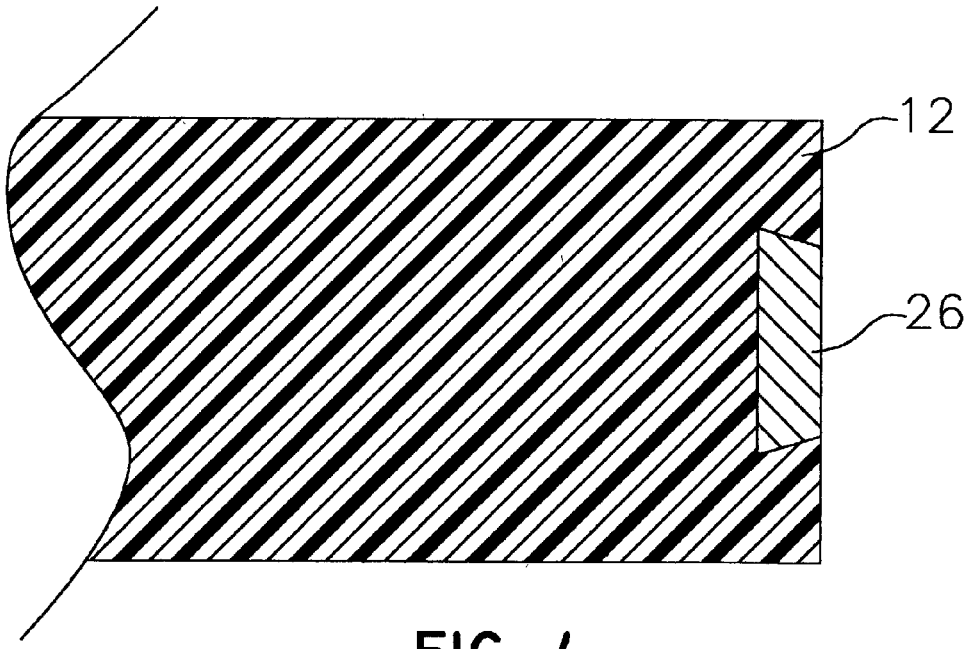
FIG. 4 is a left sectional view of the box for storing matches of the present invention.

In FIG. 4, a new and improved box for storing matches 10 of the present invention for protecting matches and making them readily available is illustrated and will be described. More particularly, the box for storing matches 10 has a match holder 12. Strike strip 26 is shown attached to the rear wall of match holder 12.

Figure 5:
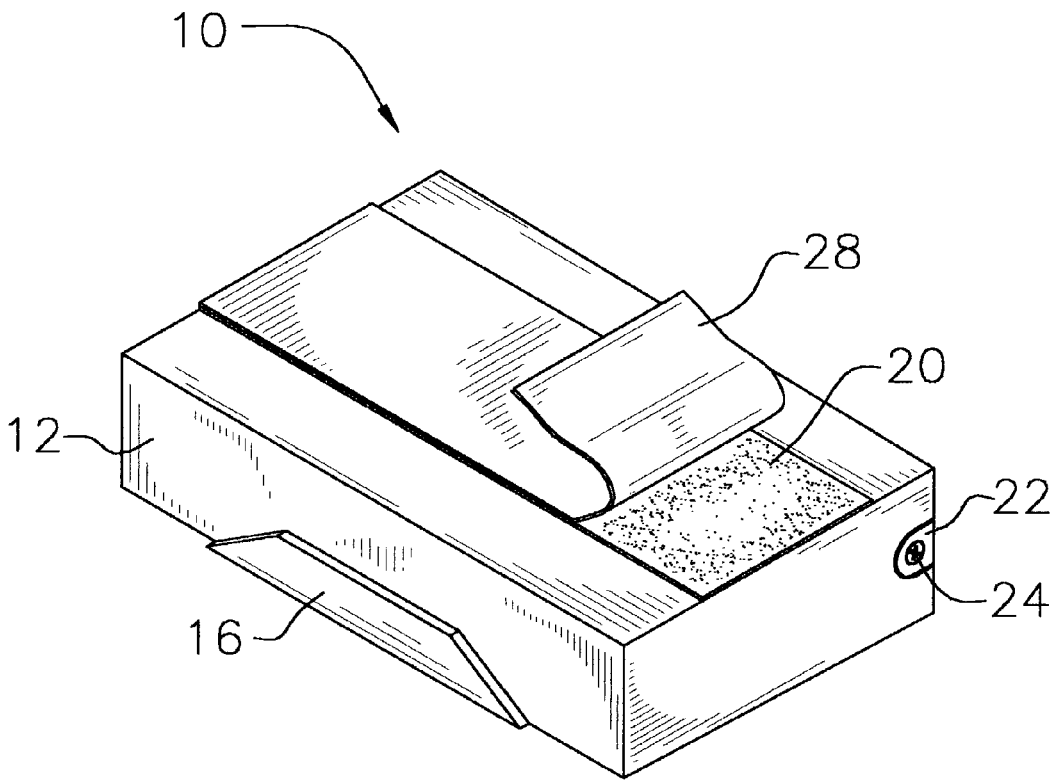
FIG. 5 is a bottom perspective view of the box for storing matches of the present invention.

Concluding with FIG. 5, a new and improved box for storing matches 10 of the present invention for protecting matches and making them readily available is illustrated and will be described. More particularly, the box for storing matches 10 has a match holder 12. Flap 16 is shown removably attached to the front wall of match holder 12. Adhesive strip 20 is shown attached to the underside of match holder 12 with adhesive protection strip 28 partially removed from adhesive strip 20. Strike strip mounting bracket 22 with screw 24 are also visible.

While a current embodiment of the box for storing matches has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy and weather resistant material such as steel, aluminum, wood, titanium, or carbon fiber composite may be used instead of the plastic match holder, lid, and flap described. Also, the strike strip may be removably attached using an appropriate variety of adhesive instead of the plurality of screws and strike strip mounting brackets described. Furthermore, a wide variety of latching mechanisms may be used instead of the hook and loop fastener described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A box for storing matches comprising:

a match holder having a front wall, a rear wall, two side walls, and a bottom wall;

a lid having a front edge and a rear edge with said rear edge hingedly coupled to said rear wall of said match holder;

a flap having an inner surface attached to said front edge of said lid;

a latching mechanism attached to said inner surface of said flap and said front wall of said match holder;

a match holder attachment mechanism attached to said bottom wall of said match holder;

a striking strip removably attached to said rear wall of said match holder; and a strike strip attachment mechanism removably attached to said strike strip;

wherein said strike strip attachment mechanism comprises:

a plurality of strike strip mounting brackets attached to said side walls of said match holder; and a plurality of screws threadedly attaching said strike strip to said side walls of said match holder.

* * * * *